US008887833B2

(12) United States Patent
Crane

(10) Patent No.: US 8,887,833 B2
(45) Date of Patent: Nov. 18, 2014

(54) REAMER ASSEMBLY

(75) Inventor: Robert F. Crane, Oconomowoc, WI (US)

(73) Assignee: Earth Tool Company, LLC, Oconomowoc, WI (US)

( * ) Notice: Subject to any disclaimer, the term of this patent is extended or adjusted under 35 U.S.C. 154(b) by 523 days.

(21) Appl. No.: 13/214,686

(22) Filed: Aug. 22, 2011

(65) Prior Publication Data

US 2012/0043132 A1 Feb. 23, 2012

Related U.S. Application Data

(60) Provisional application No. 61/375,629, filed on Aug. 20, 2010.

(51) Int. Cl.
*E21D 1/06* (2006.01)
*E21B 7/28* (2006.01)
*E21B 10/26* (2006.01)

(52) U.S. Cl.
CPC .. *E21B 7/28* (2013.01); *E21B 10/26* (2013.01)
USPC ..... 175/53; 175/320; 175/401; 175/406

(58) Field of Classification Search
None
See application file for complete search history.

(56) References Cited

U.S. PATENT DOCUMENTS

| | | | | |
|---|---|---|---|---|
| 7,152,702 | B1 | 12/2006 | Bhome et al. | |
| 7,243,737 | B2 * | 7/2007 | Michael | 175/53 |
| 8,365,841 | B2 | 2/2013 | Dimitroff | |
| 2009/0250266 | A1 * | 10/2009 | Dimitroff | 175/53 |
| 2010/0012379 | A1 * | 1/2010 | Wentworth et al. | 175/53 |

OTHER PUBLICATIONS

Railhead Underground Products, LLC "The EXTReam™ is a true rock reamer that is designed to stand up to the kind of hard rock and rocky conditions that tear up other reamers and hole openers." Page from website, 2002-2006.

Railhead Underground Products, LLC "Railhead Endurance Dirt Reamers." Page from website, 2002-2006.

* cited by examiner

*Primary Examiner* — Jennifer H Gay
*Assistant Examiner* — Caroline Butcher
(74) *Attorney, Agent, or Firm* — Tomlinson Rust McKinstry Grable

(57) ABSTRACT

An adapter for connecting drilling components having an elongate tubular member with a non-circular exterior surface profile and a connector. A ground engaging member generally characterized as a reamer has a non-circular inner surface profile whereby the ground engaging member is slidably mounted on and engages the non-circular exterior surface of the tubular member. A flange assembly is connected to the ground engaging member and the tubular member to restrict axial movement of the ground engaging member relative to the tubular member.

4 Claims, 5 Drawing Sheets

REAMER ASSEMBLY

CROSS-REFERENCE TO RELATED APPLICATIONS

This application claims the benefit of U.S. Provisional Patent Application No. 61/375,629 filed Aug. 20, 2010, the contents of which are incorporated herein by reference.

FIELD OF THE INVENTION

The invention relates to directional boring and, in particular, to a reamer assembly for enlarging an existing borehole.

SUMMARY OF THE INVENTION

The present invention is directed to a reamer for use in horizontal directional drilling operations. The reamer comprises a first member, a shaft, a flange assembly, and a reamer assembly. The first member has a non-circular exterior surface and a first connector. The shaft comprises a first end and a second end. The first end comprises a second connector for mating engagement with the first connector of the first member. The second end comprises a threaded connector. The flange assembly comprises a threaded socket and a flange. The threaded socket matingly engages with the threaded connector of the shaft. The reamer assembly comprises a reamer body and a reamer flange. The reamer body comprises a first end and a second end. The first end comprises a non-circular internal surface corresponding to the non-circular exterior surface of the first member for connecting the reamer body to the first member to transmit torque between the first member and the reamer body. The reamer flange is at the second end of the reamer body and formed for connecting the flange assembly to the reamer body. The non-circular surface of the first member and the shaft are supported within the reamer body.

The present invention is also directed to a method for making boreholes using a boring machine having a rotary drive system capable of rotating and axially advancing or retracting a downhole tool attached to a drill string. The method comprises connecting a first end of an elongate first member to the drill string. The first member comprises a second end having a non-circular outer surface. A shaft member is connected to the second end of the first member and a reamer body is slid over the shaft and the non-circular outer surface of the first member to pass rotation of the drill string and the first member to the reamer body by means of the non-circular surfaces. A flange assembly is engaged with the shaft to secure the flange assembly to the reamer body and prevent axial movement of the reamer body relative to the first member and shaft.

The invention further comprises an adapter for connecting drilling components. The adapter comprises an elongate tubular member, a ground engaging member, and a flange assembly. The elongate tubular member has a non-circular exterior surface profile and a connector. The ground engaging member comprises a non-circular inner surface profile thereof whereby the ground engaging member is slidably mounted on the non-circular exterior surface of the tubular member, when such profiles are brought into alignment by rotation of one member relative to the other, in a manner effective to pass torque from one member to the other by means of the non-circular profiles. The flange assembly comprises a flange housing and a flange. The flange is connectable with the ground engaging member to restrict axial movement of the ground engaging member relative to the tubular member. The non-circular exterior surface of the first member and the flange housing are all supported within the ground engaging member.

DESCRIPTION OF THE INVENTION

Figure 1:
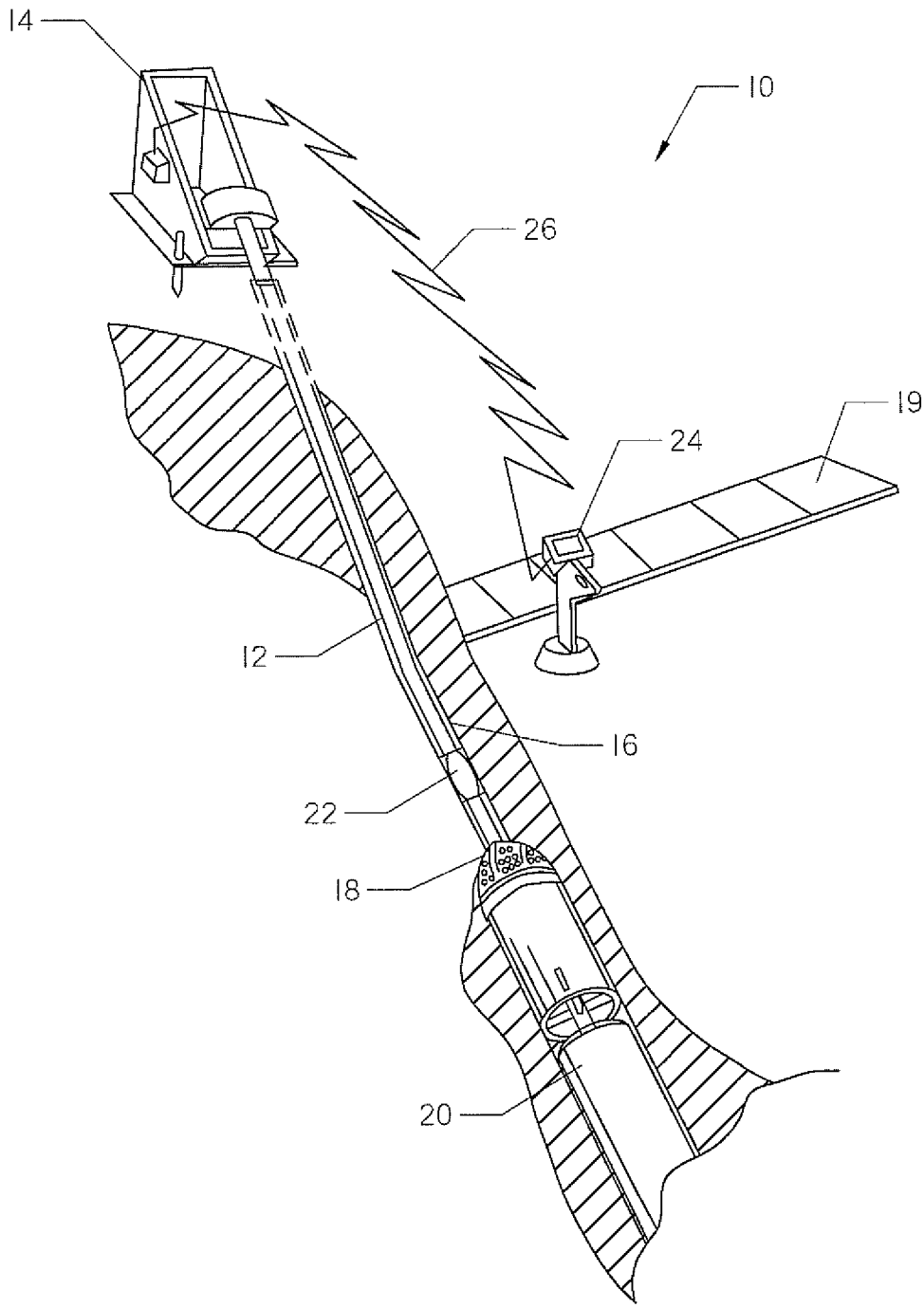
FIG. 1 is a perspective view of a reaming operation showing a reamer being pulled through the ground.

Directional boring apparatus for making holes through soil are well known. The directional boring system 10 generally includes a series of drill pipes joined end-to-end to form a drill string 12. The drill string 12 is pushed or pulled through the ground by means of a drilling machine 14. In a boring operation a directional drill head (not shown) is rotated and pushed through the ground to create a pilot bore 16. A reamer 18 is attached to the drill string 12 at an exit pit of the pilot bore 16 and pulled back through the pilot bore to enlarge the bore and install the product pipe 20. Because reamers are typically larger than the drill bit and typically long in length, installation of the reamer 18 on the end of the drill string 12 often requires the operator dig a large exit pit to fit the reamer onto the end of the drill string.

It may be advantageous to assemble reamers used in horizontal directional drilling ("HDD") operations from components in a manner that makes use of the individual subsystems yet provides the performance and bore size required to install the product pipe 20. Subsystems are lighter than a fully assembled reamer; therefore they are easier to handle and connect to the end of the drill string 12. Further, reuse of certain subsystems such as bearing swivels and couplings permit greater value by eliminating the need for redundant components in each reamer.

Currently, operators purchase and maintain a complete reamer, complete from the forward coupling (typically a threaded joint) to the swivel. Typically only the ground engagement device (reamer body) differs in size or design for different applications. The reamer's coupling, center shaft, and bearing are often like components even in different size and style reamers.

Turning now to the drawings in general and FIG. 1 specifically, shown therein is the HDD system 10 pulling a reamer 18 through the ground and under a surface obstruction 19. The reamer 18 is connected to the drill string 12 and is pulled through the ground by the rotary drive machine 14. A beacon 22 may be supported ahead of the reamer 18 and used to transmit a tracking signal to an above-ground receiver 24. The tracking signal may be used to determine the position of the reamer 18 underground and to communicate operational information such as reamer pitch, roll, or yaw information. The receiver 24 may comprises a walkover tracker capable of detecting the tracking signal and transmitting the operational information and position of the reamer 18 to the drive machine 14 via a wireless communication link 26. Reamer pitch, roll and yaw information can be important in on-grade installations and when navigating around under-ground obstructions.

Figure 2:
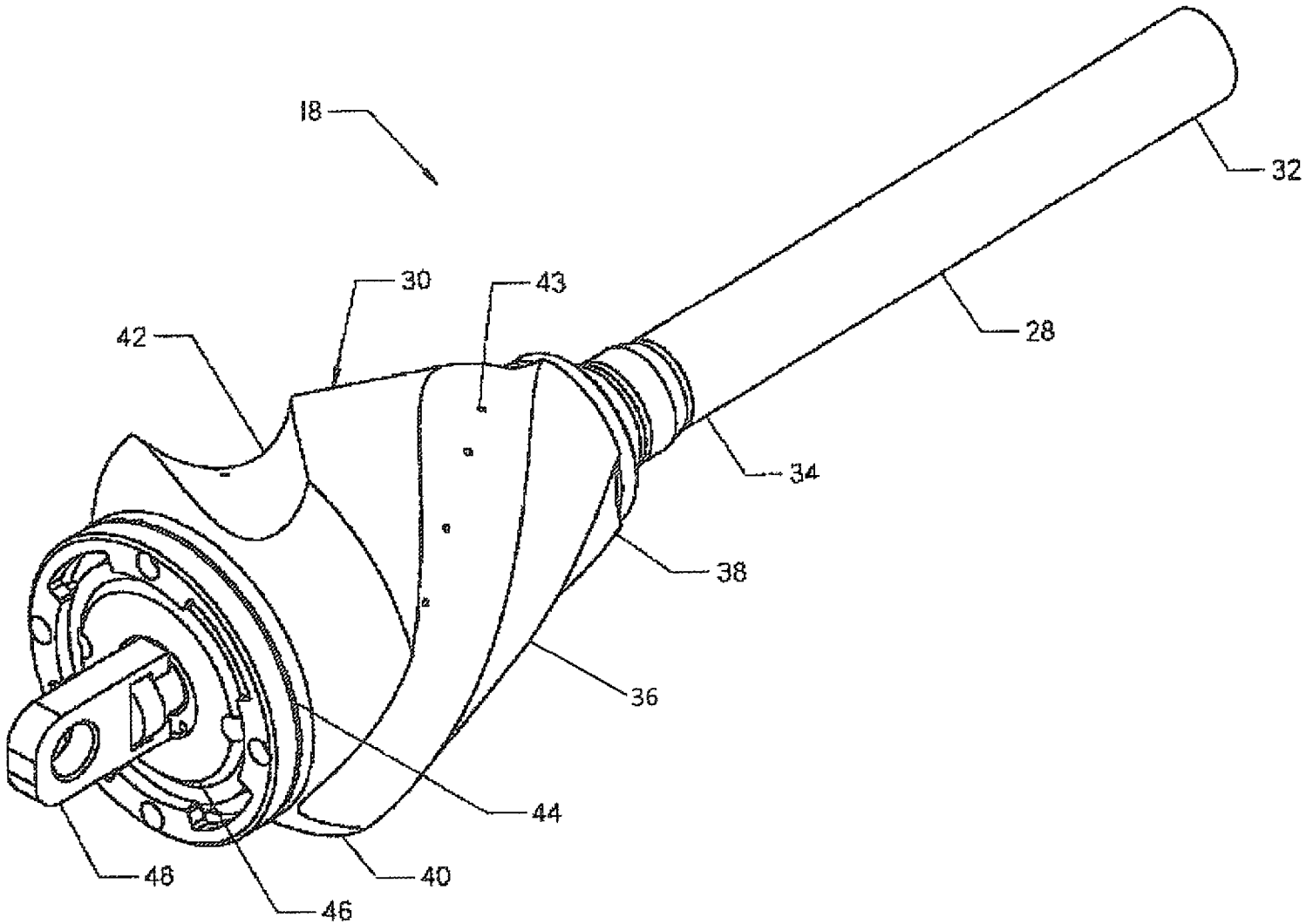
FIG. 2 is a perspective view of the reamer of the present invention.

Referring now to FIG. 2, a front perspective view of the reamer 18 is shown. The reamer 18 comprises a first member 28 and a reamer assembly 30. The first member 28 has a first end 32 and a second end 34. The reamer assembly 30 includes a reamer body 36 comprising a first end 38 and a second end 40. The reamer body 36 may be frustoconical having a smaller diameter at the first end 38 and a larger diameter at the second end 40. The reamer body 36 may comprise a plurality of flutes 42 formed to allow for the mixing and movement of cutting spoils. A series of holes 43 are formed on the reamer body 36 to inject fluid into the surrounding borehole for mixing with cutting spoils.

A reamer flange 44 is supported at the second end 40 of the reamer body 36. The reamer flange 44 is formed for connecting a flange assembly 46 to the reamer body. The reamer flange 44 is formed for connecting the flange assembly 46 to the reamer body 36. The flange assembly 46 may comprise a product pipe lug 48 supported by the flange assembly 46.

Figure 3:
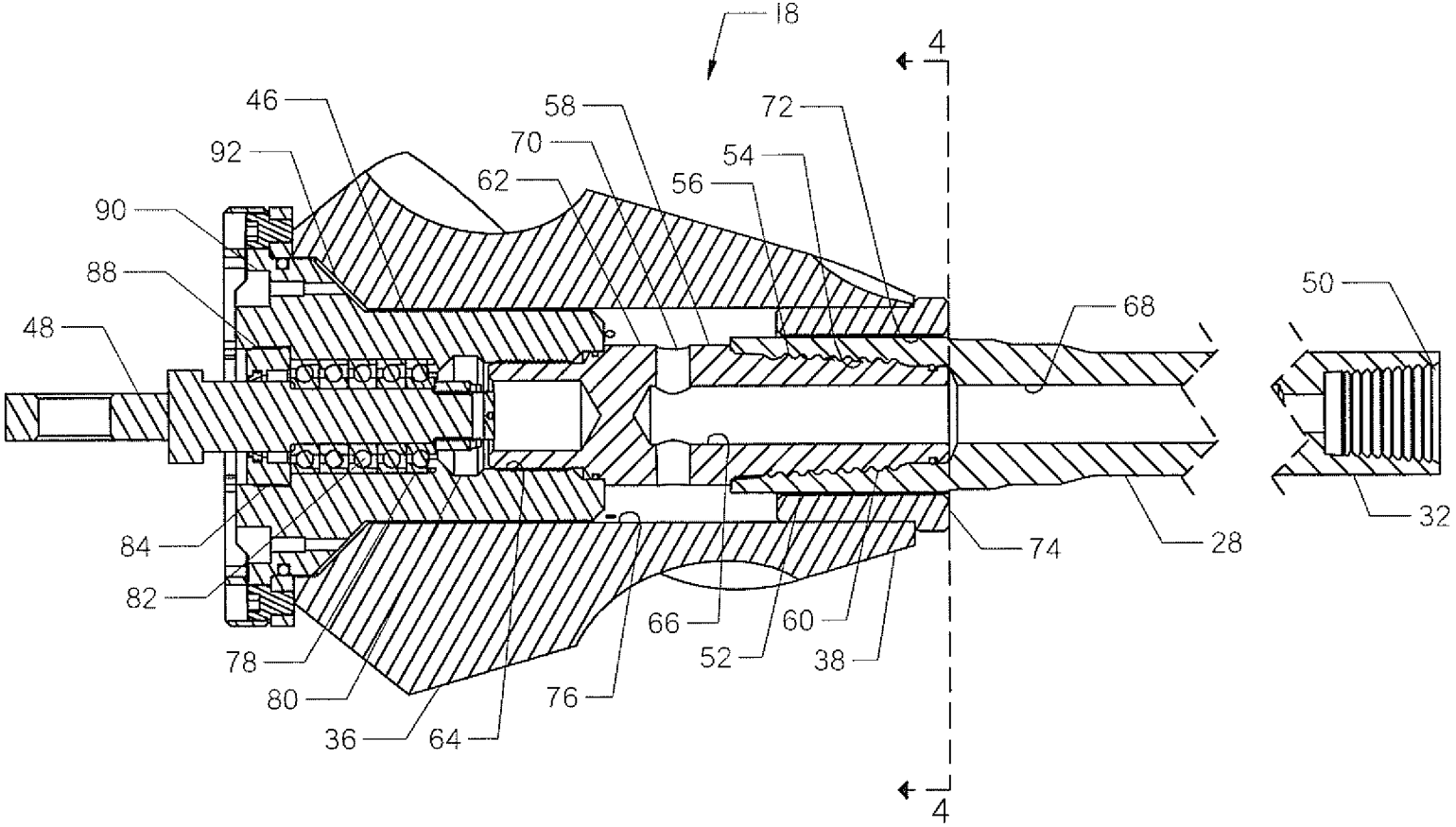
FIG. 3 is sectional view of the reamer shown in FIG. 2.

Turning now to FIG. 3, the reamer 18 of FIG. 2 is shown in a sectional view. The first end 32 of the first member 28 is shown with a threaded socket 50 for connection to the drill string 12 (FIG. 1). The second end 34 of the first member 28 comprises a non-circular exterior surface 52 (FIG. 4) and a first connector 54. The first connector 54 may comprise an internally threaded socket formed for mating engagement with a second connector 56 of a shaft 58. The shaft 58 comprises a first end 60 and a second end 62. The first end 60 comprises the second connector 56. The second end 62 of the shaft 58 may comprise an externally threaded end portion connectable with an internally threaded socket 64 of the flange assembly 46. The shaft 58 comprises an internal passage 66 in fluid communication with an internal passage 68 formed in the first member 28. The internal passage 66 is in fluid communication with a port 70 formed in the shaft 58 to allow fluid from the internal passage 66 to flow into the reamer body 36.

The first end 38 of the reamer body 36 comprises a non circular internal surface 72 corresponding to the non-circular exterior surface 52 of the first member 28 for connecting the reamer body to the first member to transmit torque between the first member and the reamer body. The embodiment of FIG. 3 shows a sleeve 74 having the non-circular interior surface 72 mounted within the reamer body 36. One skilled in the art will appreciate that the inner wall 76 of the reamer body 36 may form a non-circular internal surface engagable with the first member 28 without departing from the spirit of the invention.

The second end 62 of the shaft 58 mates via its threaded connector with the threaded socket 64 of the flange assembly 46. The flange assembly 46 may comprise a bearing assembly 78 to allow the reamer assembly and flange assembly to rotate independently of the product pipe lug 48. Product pipe 20 (FIG. 1) attaches to the product pipe lug 48. Product pipe lug 48 is contained by nut 80. Bearings 82 are contained within the flange assembly 46 by seal carrier 84. Seal carrier 84 mounts seal 86 to prevent the ingress of drilling fluids into bearings 82 along product pipe lug 48. Seal carrier 84 is attached to the flange assembly 46 via threaded set 88.

The flange assembly 46 may comprise discharge ports 90 to allow fluid that has passed from the internal passage 66 of the shaft 58, through ports 70 into the reamer body passage 66 and through an annular space 92 formed around the flange assembly. Drilling fluid from the ports 90 is generally unmixed with the cutting spoils and will reduce the surface drag forces exerted on the product pipe 20 as it is pulled into the borehole behind the reamer 18.

Figure 4:
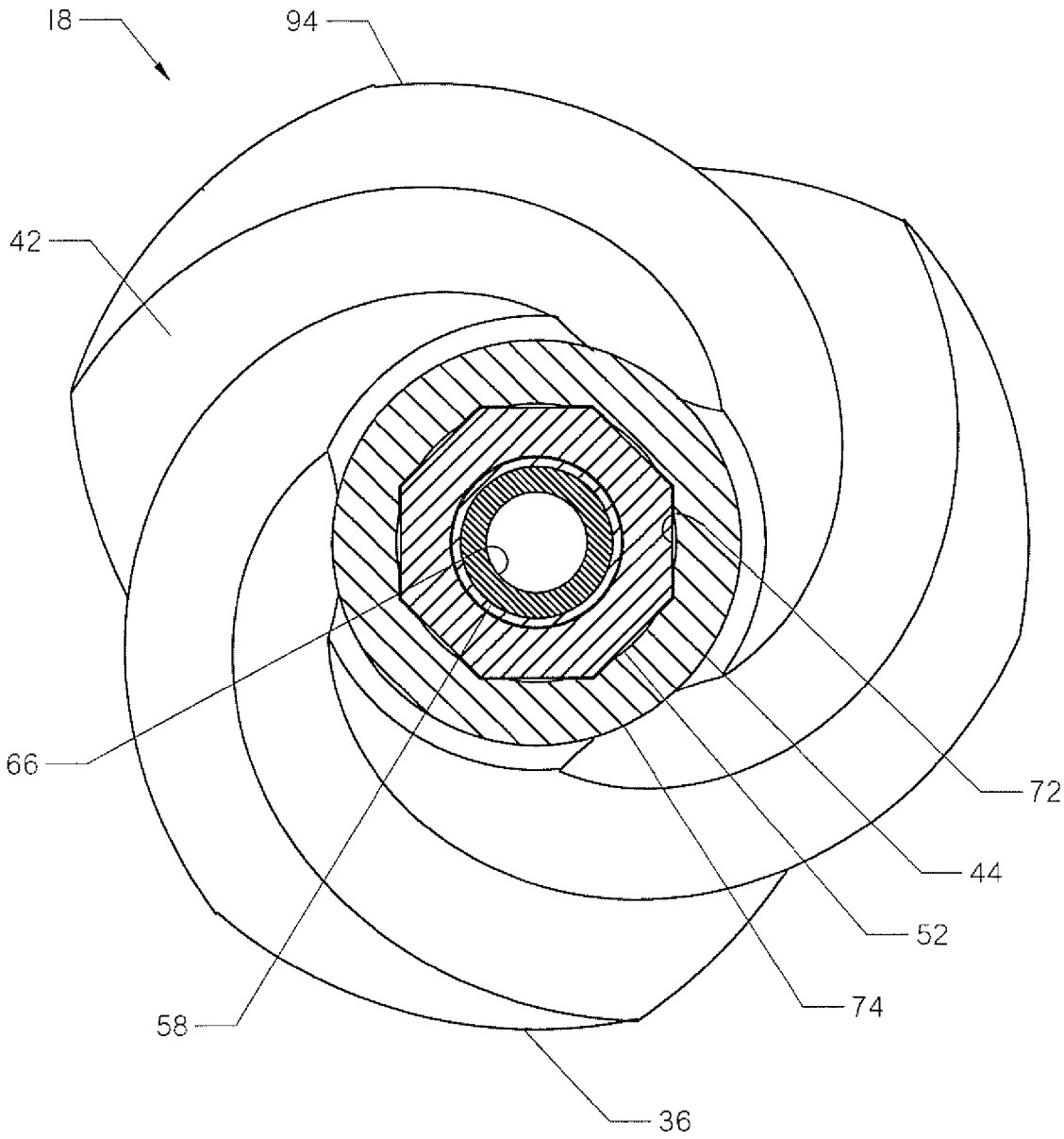
FIG. 4 is a cross section view of the reamer assembly along line 4-4 of FIG. 3.

Turning now to FIG. 4, a cross-section view of the reamer assembly 18 taken along line 4-4 of FIG. 3 is shown. The non-circular internal surface 72 of the sleeve 44 is shown mating with the non-circular exterior surface 52 of the first member 28. This connection allows the first member 28 to transmit torque between the first member and the reamer body 36. One skilled in the art will appreciate the non-circular connection between the first member 28 and the reamer body 36 may comprise many different forms such as a octagonal or hexagonal geometric profile or a spline and groove profile without departing from the spirit of the present invention.

The view of the reamer assembly 18 shown in FIG. 4 further illustrates the frustoconical profile of the reamer body 36. FIG. 4 also shows the flute 42 and ridge 94 design of a preferable reamer body 36. However, one skilled in the art will appreciate that a reamer body 36 having a different profile may be used in accordance with the present invention.

Figure 5:
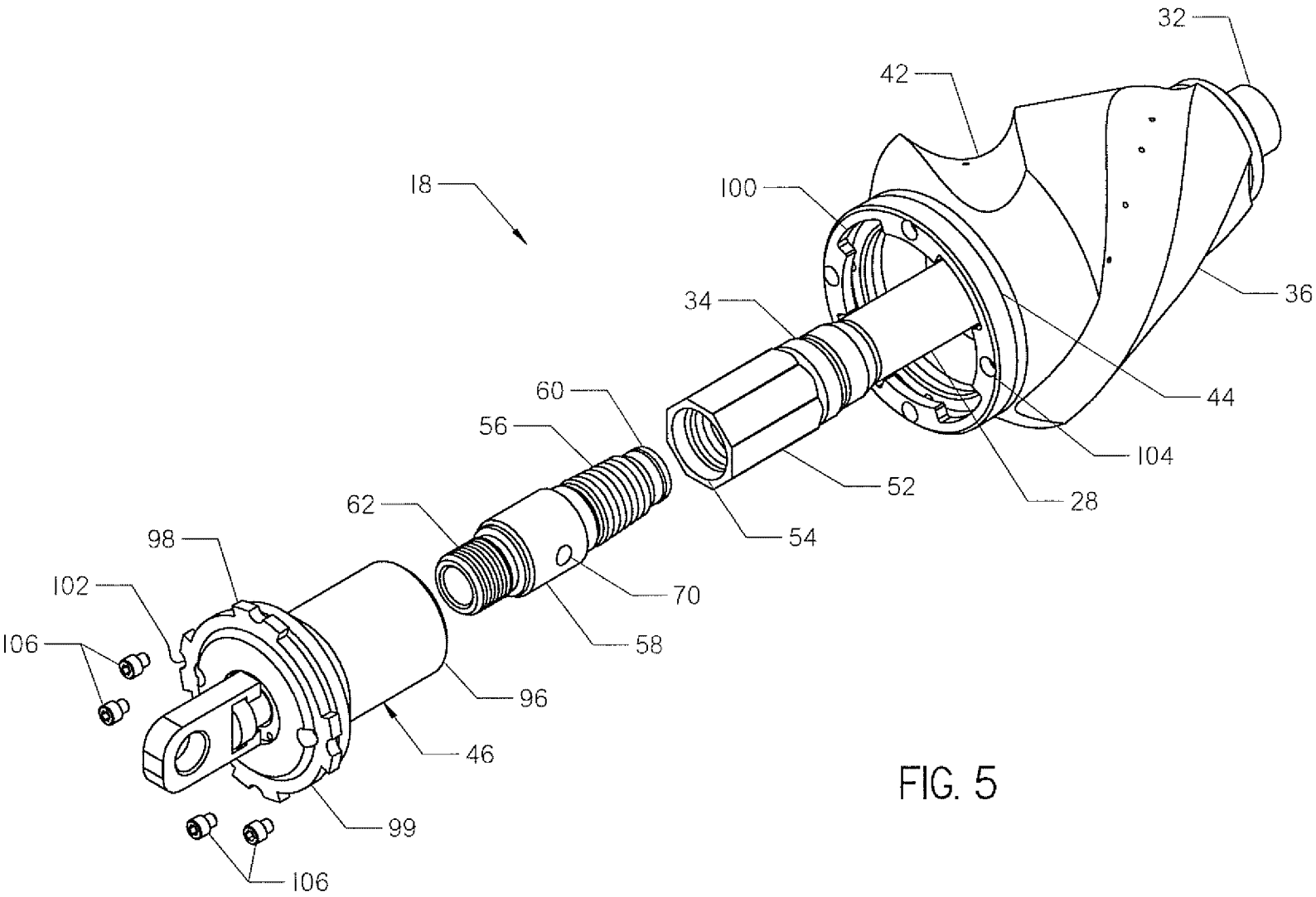
FIG. 5 is an exploded view of the reamer of FIG. 2.

Turning now to FIG. 5, the reamer 18 is shown in exploded view to further illustrate the assembly of the reamer. The first end 32 of the first member 28 is connected to the drill string 12 (FIG. 1). The shaft member 58 is connected to the first connector 54 formed at the second end 34 of the first member 28. FIG. 5 illustrates the second end 34 of the first member 28 may comprise a non-circular exterior surface 52 and the first connector 54 may comprise an internally threaded socket. The connection between second connector 56 and first connector 54 may also take the form of any conventional coupling or joint used to connect underground directional drilling tools and may comprise part of such a tool. One such coupling system is known commercially as Splinelok™ wherein interlocking splines that pass torque from the drill string to a tool as described in Wentworth et al., published U.S. Patent Application Serial No. 2001/0017222, the disclosure of which is incorporated herein by reference for all purposes.

The second end 62 of shaft 58 may also form a threaded connection with the threaded socket 64 of the flange assembly 46. Once the connections are made, the reamer body 36 is slid over the non-circular exterior surface 52, the shaft 58, and the flange assembly 46 so that the housing 96 of the flange assembly 46 and the shaft 58 are contained within the reamer body 36. The reamer body 36 is secured to the flange assembly 46 to prevent axial movement of the reamer body relative to the first member 28 and shaft 58.

The reamer body 36 is secured by the flange assembly 46 and the reamer flange assembly 44. The flange 46 comprises a plurality of bayonet tabs 98 formed about the periphery of a flange 99. The tabs 98 are inserted through a plurality of similarly formed bayonet notches 100 formed about the periphery of the reamer flange 44. After the tabs 98 have been inserted through the tabs 100 into a diametral clearance provided by reamer flange 44, the entire flange assembly 46 is oriented to align a groove 102 formed in each tab with holes 104 formed in the reamer flange 44. In the embodiment of FIG. 5 the flange assembly 46 is rotated 45 degrees to align the grooves 102 with holes 104. A plurality of fasteners 106 may be threaded into the holes 104 to secure the reamer body 36 to the flange assembly 46.

In the assembly process of the present invention the entire assembly need never be lifted by the assembler, rather it is built up using components that are a fraction of the entire assembled weight. Further, while a different size reaming operation will require a new reamer body 36 and possibly a new shaft 58, the flange assembly 46 can be reused thereby eliminating the need to procure certain pieces of redundant equipment.

The present invention includes a method for making boreholes using a boring machine 14 having a rotary drive system capable of rotating and axially advancing or retracting a downhole tool 18 attached to the drill string 12. In the method of the present invention the first end 32 of the elongate first member 28 is connected to the drill string 12. The first end 32 may be connected to the drill string 12 by rotating the first member 28 or the drill string in a first direction to thread the first member to the drill string. The shaft member 58 is connected to the second end 34 of the first member 28. In the embodiment illustrated herein, the shaft member 58 is threaded into the socket 54 of the first member 28.

The ground engaging member comprising a reamer body 36 is slid over the shaft 58 and the non-circular outer surface 52 of the first member so that outer surface 52 engages the non-circular internal surface 72 of the reamer body sleeve 74. In order for the reamer body 36 to slide into position on the first member 28, it may be necessary to align the non-circular profiles of both components before sliding the reamer body over the second end 34 of the first member.

Next, the flange assembly 46 is engaged with the shaft 58 by threading the flange assembly onto the second end 62 of the shaft. In the embodiment disclosed herein, the flange assembly 46 may be threaded onto the shaft 58 so that the housing 96 is supported within the reamer body 36. The reamer body 36 is slid toward the flange assembly 46 and the reamer body and flange assembly are rotated relative to each other to align the notches 100 and tabs 98. The tabs are inserted into the reamer flange 44 and the flange assembly 46 is rotated 45 degrees to align the grooves 102 with holes 104. A fastener 106 may then be inserted into each hole 104 to fasten the flange assembly 46 and reamer body 36 to prevent axial movement of the reamer body relative to the first member 36 and shaft 58.

While certain embodiments of the invention have been illustrated for the purposes of this disclosure, numerous changes in the method and apparatus of the invention presented herein may be made by those skilled in the art, such changes being embodied within the scope and spirit of the present invention as defined in the appended claims.

What is claimed is:

1. An adapter for connecting drilling components, the adapter comprising:

an elongate tubular member having a non-circular exterior surface profile and a connector;

a ground engaging member comprising a non-circular inner surface profile thereof whereby the ground engaging member is slidably mounted on the non-circular exterior surface of the tubular member, when such profiles are brought into alignment by rotation of one member relative to the other, in a manner effective to pass torque from one member to the other by means of the non-circular profiles;

a shaft disposed within the ground engaging member and comprising a first end and a second end, the first end comprising a second connector for mating engagement with the connector of the elongate tubular member, the second end comprising a threaded connector; and a flange assembly comprising a flange housing and a flange, wherein the flange is connected to both the second end of the shaft and the ground engaging member to restrict axial movement of the ground engaging member relative to the tubular member;

wherein the non-circular exterior surface of the first member and the flange housing are all supported within the ground engaging member.

2. The adapter of claim 1 further comprising holes in the ground engaging member for receiving a fastener to secure the flange assembly to the ground engaging member.

3. The adapter of claim 1 wherein the flange assembly comprises:

a bearing assembly supported within the flange housing; and a product pipe lug supported within the flange housing by the bearing assembly and extending from a downhole end of the ground engaging member.

4. The adapter of claim 1 wherein the reamer flange comprises a plurality of bayonet notches and fastener holes and wherein the flange of the flange assembly comprises a plurality of bayonet tabs configured fit within the bayonet notches.

* * * * *